US006416402B1

(12) United States Patent
Moore

(10) Patent No.: US 6,416,402 B1
(45) Date of Patent: Jul. 9, 2002

(54) METHODS OF POLISHING MICROELECTRONIC SUBSTRATES, AND METHODS OF POLISHING WAFERS

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 86 days.

(21) Appl. No.: 09/652,531

(22) Filed: Aug. 31, 2000

Related U.S. Application Data

(62) Division of application No. 09/139,599, filed on Aug. 25, 1998, now Pat. No. 6,152,808.

(51) Int. Cl.[7] ..... B24B 1/00

(52) U.S. Cl. ..... 451/60; 451/8; 451/6; 451/289

(58) Field of Search ..... 451/60, 5, 6, 8, 451/9, 10, 11, 286, 287, 289, 41, 28, 288, 390, 456, 12, 24

(56) References Cited

U.S. PATENT DOCUMENTS

| | | | | |
|---|---|---|---|---|
| 5,205,082 A | | 4/1993 | Shendon et al. | 51/283 R |
| 5,423,716 A | | 6/1995 | Strasbaugh | 451/388 |
| 5,449,316 A | | 9/1995 | Strasbaugh | 451/289 |
| 5,722,877 A | | 3/1998 | Meyer et al. | 451/303 |
| 5,762,536 A | | 6/1998 | Pant et al. | 451/303 |
| 5,913,714 A | * | 6/1999 | Vlovdarsky et al. | 451/56 |
| 5,938,502 A | | 8/1999 | Kubo | 451/6 |
| 6,000,996 A | | 12/1999 | Fujiwara | 451/6 |
| 6,146,241 A | * | 11/2000 | Lee et al. | 451/11 |
| 6,149,508 A | * | 11/2000 | Vanell et al. | 451/56 |
| 6,332,827 B1 | * | 12/2001 | Gottschald et al. | 451/6 |

OTHER PUBLICATIONS 3 informational printouts from Internet website of HUMIDIAL, 6 total pages, date printed Apr. 29, 1998.
1 informational printout from BANNER website, 2 total pages, date printed Apr. 29, 1998.
"Introduction to Photoelectric Sensors." Banner Engineering Corp., 1996; 12 pages.
1 informational printout from KEYENCE website, 2 total pages, date printed Apr. 29,1998.
1 informational printout from ATOZINDIA website, "Desiccant Silica Gel," 2 total pages, date printed Apr. 29, 1998.
1 informational printout from THOMAS REGISTER website, "Silica Gel Technical Data Sheet ADCOA Moisture–Indicating Grades," 2 pages, date printed Apr. 29, 1998.

* cited by examiner

*Primary Examiner*—Joseph J. Hail, III
*Assistant Examiner*—Hadi Shakeri
(74) *Attorney, Agent, or Firm*—Wells St. John P.S.

(57) ABSTRACT

Microelectronic substrate polishing systems and methods of polishing microelectronic substrates are described. In one embodiment, a substrate carrier includes a resilient member and a vacuum mechanism. The vacuum mechanism is coupled to the substrate carrier and configured to develop pressure sufficient to draw a portion of the resilient member toward the substrate carrier. The drawing of the resilient member effects an engagement between the resilient member and a substrate which is received by the substrate carrier. A polishing fluid sensor is provided and coupled intermediate the resilient member and the vacuum mechanism. In another embodiment, the polishing fluid sensor is coupled intermediate the substrate carrier and the vacuum mechanism. In another embodiment, the vacuum mechanism comprises a vacuum conduit through which a vacuum is developed. The polishing fluid sensor can be mounted on or in the vacuum conduit. Various types of fluid sensors can be utilized, including resistive, capacitive, pressure-based, and/or photo detectors. In a preferred embodiment, the microelectronic substrate comprises a semiconductor wafer.

15 Claims, 7 Drawing Sheets

METHODS OF POLISHING MICROELECTRONIC SUBSTRATES, AND METHODS OF POLISHING WAFERS

RELATED PATENT DATA

This patent resulted from a divisional application of U.S. patent application Ser. No. 09/139,599, filed Aug. 25, 1998 U.S. Pat. No. 6,152,808, entitled "Microelectronic Substrate Polishing Systems, Semiconductor Wafers Polishing Systems, Methods of Polishing Microelectronic Substrates, and Methods of Polishing Wafers," naming Scott E. Moore as inventor, the disclosure of which is incorporated by reference.

TECHNICAL FIELD

The present invention pertains to microelectronic substrate polishing systems, to semiconductor wafer polishing systems, to methods of polishing microelectronic substrates, and to methods of polishing wafers.

BACKGROUND OF THE INVENTION

During fabrication of microelectronic substrates, e.g. semiconductor wafers, the substrates can be polished through mechanical abrasion, as by chemical-mechanical polishing. During chemical-mechanical polishing, a substrate carrier typically holds a substrate while either or both of the substrate carrier and a polishing platen rotatably engage and thereby polish the substrate. Polishing of the substrate can be facilitated through the use of a polishing fluid or chemical slurry.

Some types of substrate carriers use vacuum pressure to hold a substrate on the substrate carrier. Of those types of substrate carriers, some use a resilient member which can engage the substrate in a suction-like configuration. Such suction can take place before, during, and/or after polishing. Exemplary carriers are described in U.S. Pat. Nos. 5,423,716, 5,449,316, and 5,205,082, the disclosures of which are incorporated by reference.

Of those types of carriers which use vacuum pressure to hold a substrate in place, problems can arise if a system malfunction allows polishing fluid or slurry to enter into the vacuum system. More specifically, in those types of vacuum systems that use a resilient member, a breach or tear in the resilient member can allow polishing fluid or slurry to enter into the vacuum system and possibly foul equipment such as pneumatic control systems and the like.

Accordingly, this invention arose out of concerns associated with providing improved microelectronic substrate polishing equipment and methods of polishing microelectronic substrates.

SUMMARY OF THE INVENTION

Microelectronic substrate polishing systems and methods of polishing microelectronic substrates are described. In one embodiment, a substrate carrier includes a resilient member and a vacuum mechanism. The vacuum mechanism is coupled to the substrate carrier and configured to develop pressure sufficient to draw a portion of the resilient member toward the substrate carrier. The drawing of the resilient member effects an engagement between the resilient member and a substrate which is received by the substrate carrier. A polishing fluid sensor is provided and coupled intermediate the resilient member and the vacuum mechanism. In another embodiment, the polishing fluid sensor is coupled intermediate the substrate carrier and the vacuum mechanism. In another embodiment, the vacuum mechanism comprises a vacuum conduit through which a vacuum is developed. The polishing fluid sensor can be mounted on or in the vacuum conduit. Various types of fluid sensors can be utilized, including resistive, capacitive, pressure-based, and/or photo detectors. In a preferred embodiment, the microelectronic substrate comprises a semiconductor wafer.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
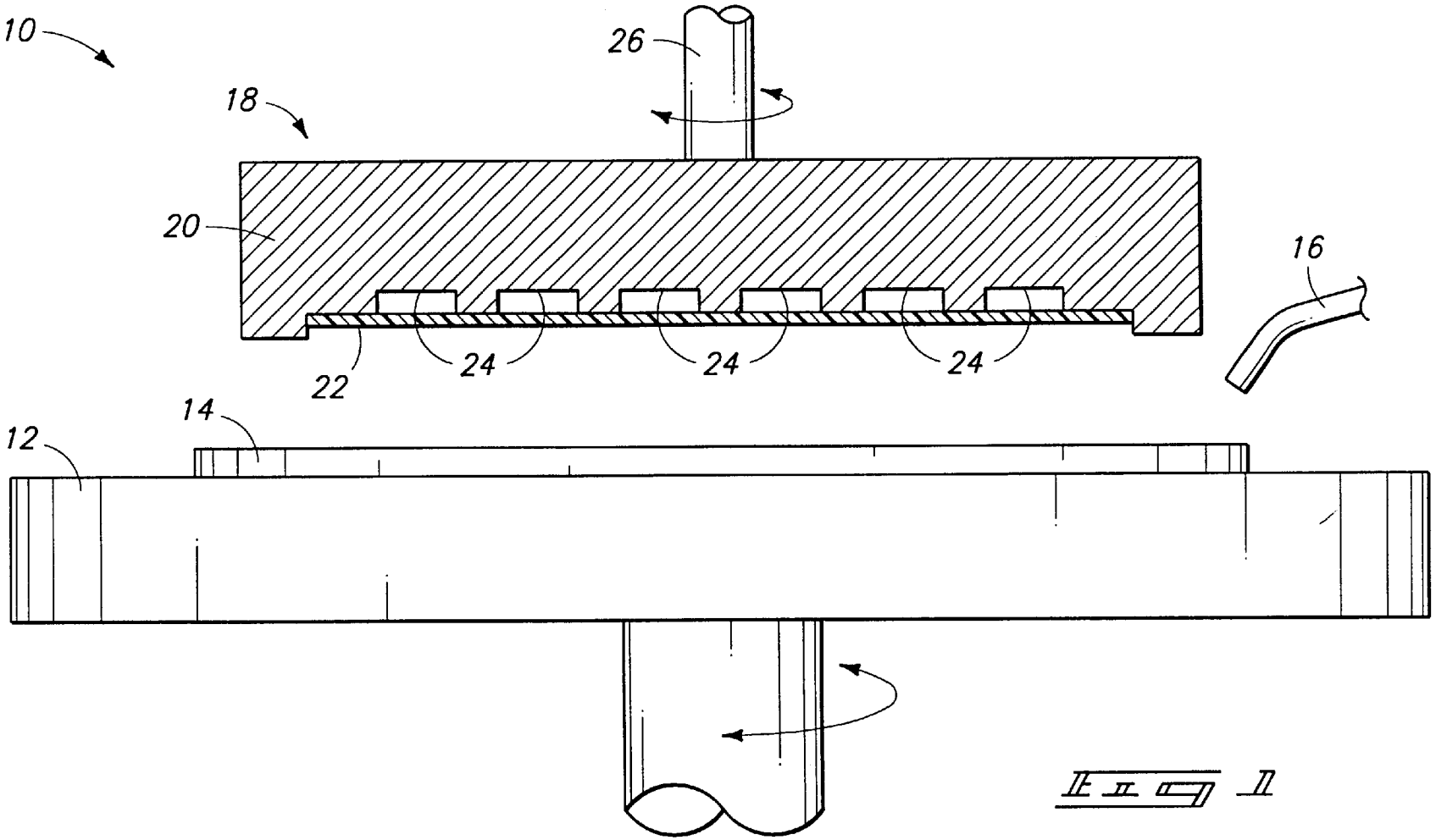
FIG. 1 is an elevational view of a microelectronic substrate polishing system in accordance with one embodiment of the invention.

Referring to FIG. 1, a simplified exemplary microelectronic substrate polishing system is shown generally at 10 and includes a platen 12, a polishing pad 14 mounted upon platen 12, a polishing fluid source 16 for delivering an amount of polishing fluid or slurry, and a polishing head 18 having a microelectronic substrate carrier 20. Substrate carrier 20 includes a resilient member 22 mounted thereon and configured to receive a microelectronic substrate which is to be polished by system 10. Resilient member 22 can comprise any suitable material having characteristics which enable it to engage a substrate as described below. Such materials include various elastomeric materials. Either one or both of platen 12 and substrate carrier 20 can be rotated during polishing of the substrate. While the inventive systems and methods can have use in a variety of polishing systems, such have been found to be particularly useful in the context of those systems which use vacuum pressure applied to and through a resilient member to hold a substrate in place. Exemplary systems are described in U.S. Pat. No. 5,423,716. In a preferred embodiment, the microelectronic substrate which is processed in accordance with the description given below comprises a semiconductor wafer. Other microelectronic substrates can, of course, be utilized. For example, field emission displays or base plates for field emission displays constitute exemplary microelectronic substrates which can be processed in accordance with the description given below.

Figure 6:
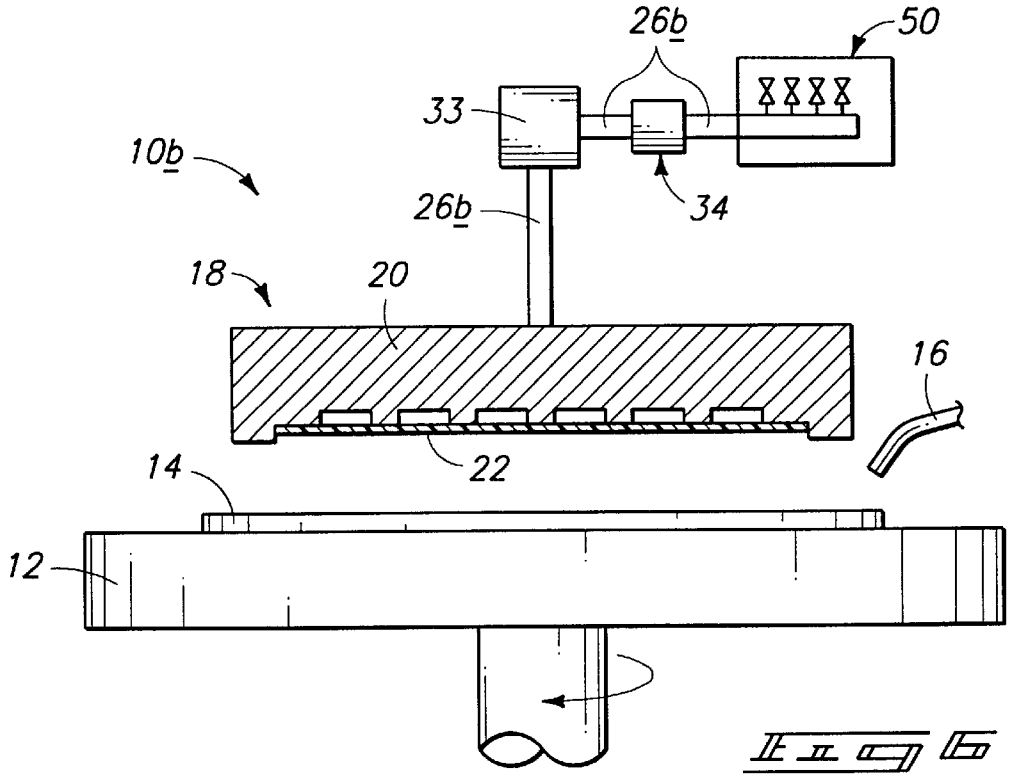
FIG. 6 is an elevational view of a polishing system which includes a substrate carrier in accordance with one embodiment of the invention.
Figure 7:
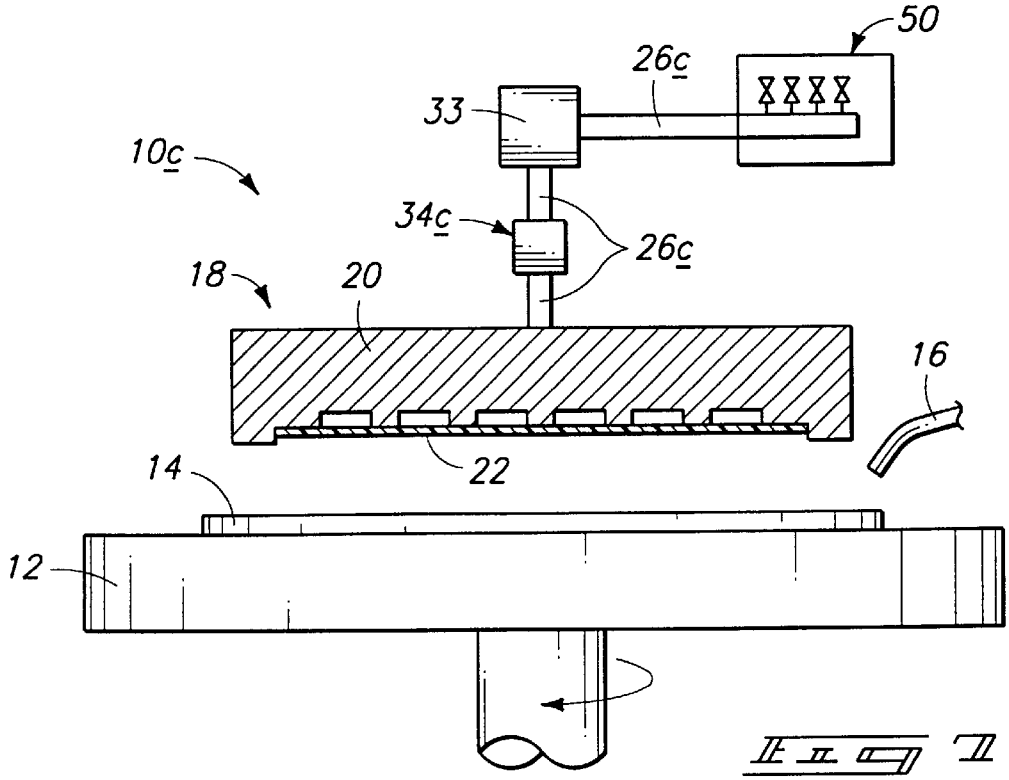
FIG. 7 is an elevational view of a polishing system which includes a substrate carrier in accordance with another embodiment of the invention.

A plurality of vacuum intake openings 24 can be provided within the substrate carrier 20 and in close proximity with or adjacent resilient member 22. The openings can be operably connected with one another or can be separate independent openings. A vacuum mechanism, such as the one shown at 50 in FIGS. 6 and 7, is coupled to substrate carrier 20 and provided into operative communication with resilient member 22 through openings 24. The vacuum mechanism can comprise any suitable vacuum mechanism configured to develop pressure which is sufficient to draw a portion of resilient member 22 toward the substrate carrier which, in turn, effectively engages a substrate in a suction-like fashion. Vacuum mechanisms such as vacuum mechanism 50 will typically include a pressure sensor to sense pressures developed by the vacuum mechanism. The vacuum mechanism can operate in any suitable manner and through the use of any suitable medium, e.g. fluids, gases etc., to develop the desired vacuum pressure effective to engage the resilient member.

Figure 2:
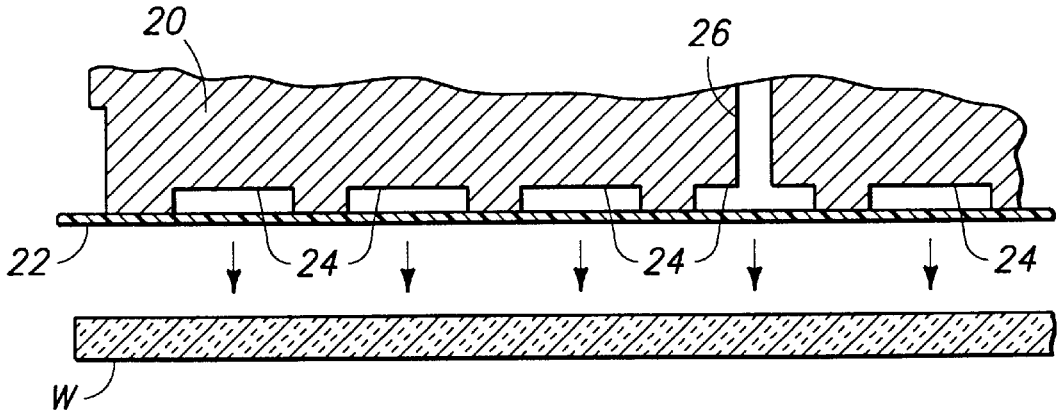
FIG. 2 is a view of a portion of a polishing system similar to the one shown in FIG. 1.
Figure 3:
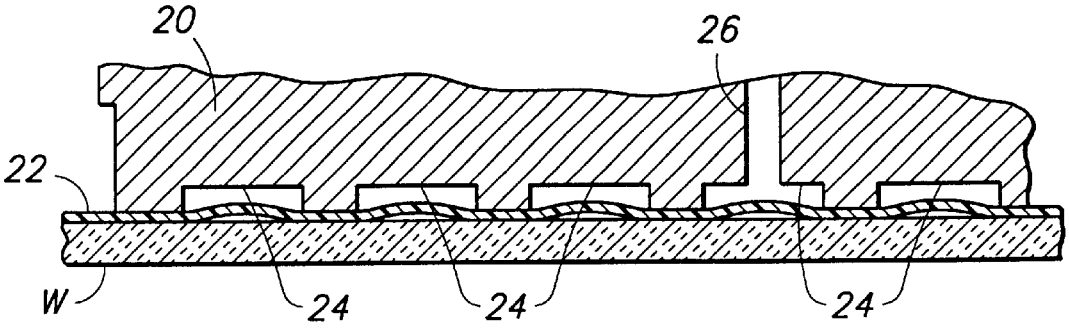
FIG. 3 is a view of the FIG. 2 polishing system engaging a substrate comprising a semiconductor wafer.

Referring to FIGS. 2 and 3, a suction-like engagement of a substrate in the form of a semiconductor wafer W is shown in more detail. FIG. 2 shows wafer W in an unengaged position in which carrier 20 is disposed in a spaced relation thereover. FIG. 3 shows wafer W as being engaged and thereby retained by carrier 20 in a suction-like manner through resilient member 22. Specifically, when in the FIG. 3 engaged position, a vacuum conduit 26 enables pressure to be applied sufficiently to draw up individual portions of resilient member 22 into individual openings 24 to form a plurality of individual suction elements dimensioned to engage individual portions of wafer W. Such forms a suction-like connection between the resilient member and wafer W thereby retaining the wafer thereon.

Referring to FIGS. 4–7 and 9–11 various embodiments of the present invention are shown to provide leak sensors or detectors which enable detection of the presence of polishing fluid within conduit 26, or, otherwise enable detection of a breach or rupture of the resilient member by the polishing fluid. Various sensors or detectors can be utilized, and the ones below are shown for illustrative purposes only. Accordingly, types of sensors such as optoelectronic sensors, photoelectric sensors, capacitance or capacitive sensors, photosensors used to look at a moisture reactive target inline, an electrode inline to sense a change in conductivity, humidity detectors, and color change humidity indicators can be used. Various sensors including capacitive sensors are available through a company called Omron Electronics, Inc.

Preferably, various embodiments of the sensors and detectors are able to detect breaches or ruptures of the resilient member independently of the pressure developed by the vacuum mechanism. Accordingly, various embodiments described below provide sensors or detectors which are discrete from the vacuum mechanism and thereby can be insensitive to the pressures developed by the vacuum mechanism. An advantage of the sensors or detectors is that one is enabled to detect a breach of resilient member 22 by the polishing fluid, whether that breach comes in the form of a rupture of the member or a circumvention of the resilient member by the polishing fluid. It will also be appreciated that the various described embodiments can be extremely sensitive to the presence of fluid within the vacuum conduit, sensing even minute quantities which, if left undetected, could have long term equipment failure ramifications.

Figure 4:
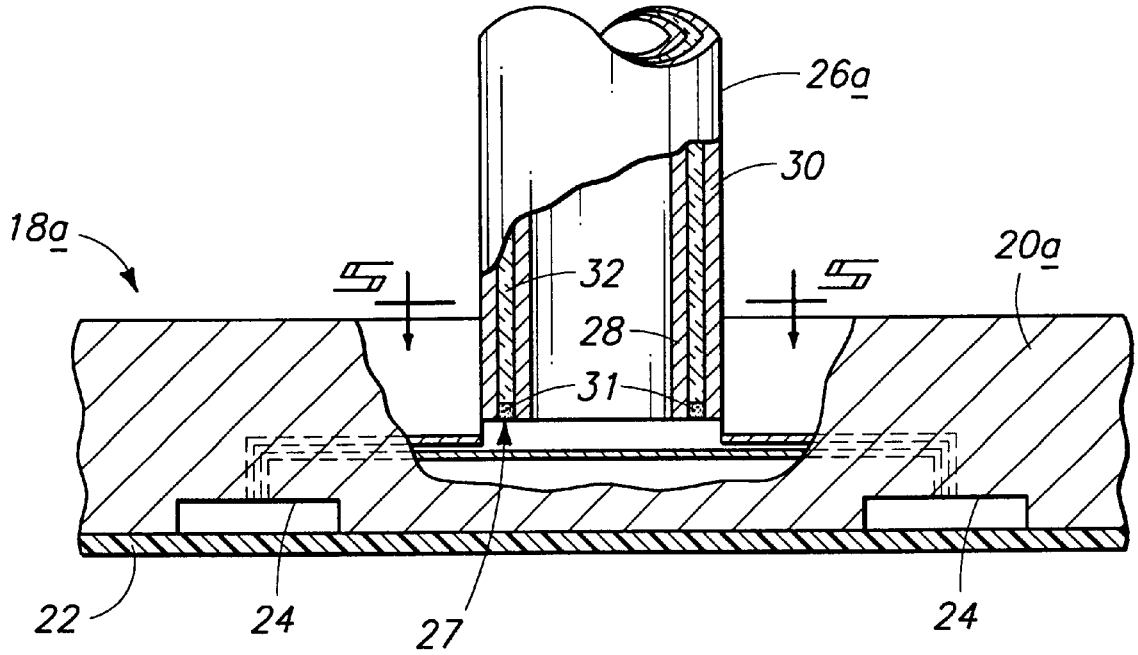
FIG. 4 is a view of a portion of a polishing system in accordance with one embodiment of the invention.
Figure 5:
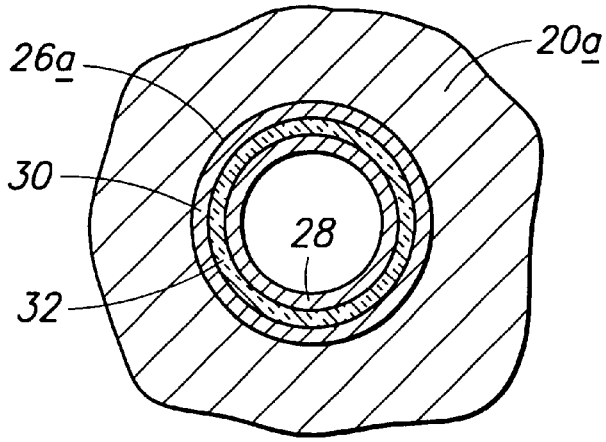
FIG. 5 is a view which is taken along line 5—5 in FIG. 4.

Referring to FIG. 4, like numerals from the above-described embodiment have been utilized where appropriate, with differences being indicated by the suffix "a." Accordingly, a vacuum conduit **26*a* is provided and is coupled intermediate resilient member 22 and a vacuum mechanism, such as the one shown at 50 in FIGS. 6 and 7. FIG. 4 shows but one example of a resistive or which is operable to sense the presence of polishing fluid. In this example, vacuum conduit 26*a* is itself inherently a polishing fluid sensor. Specifically, conduit 26*a* has a distal end defining an opening 27 which provides a vacuum intake. The vacuum intake is operably connected with one or more of the openings 24. A resistor assembly is provided and includes a first resistive element 28 and a second resistive element 30. The resistive elements are positioned closely proximate opening 27** and in this example help to define the opening. The elements are preferably spaced apart and configured to detect the presence of a polishing fluid thereacross. The vacuum conduit can have any suitable shape, and in this example it is generally circular in transverse cross-section, with first and second resistive elements being concentrically positioned relative to the opening.

A dielectric material element 32 can be provided intermediate first and second resistive elements 28, 30. In this example, dielectric material element 32 has a tip 31 comprising impregnated dried salts which facilitate detection of fluid. The resistor assembly comprises a bridge resistor having first and second resistor electrodes 28, 30 respectively. In operation, the presence of a polishing fluid across the electrodes (and hence a breach of resilient member 22) places the electrodes into bridging electrical contact and changes the resistance therebetween, thereby enabling a control/monitoring system coupled therewith, such as system 100 in FIG. 8, to detect a change in resistance and indicate the presence of polishing fluid. Upon sensing the resistance change and responsive to polishing fluid entering the vacuum conduit, the control/monitoring system can implement remedial control measures to ensure the continued integrity of the polishing system. For example, the system can be automatically shut down or purged to expel polishing fluid. Although the resistive sensor is shown to be mounted adjacent the opening of the vacuum conduit, such a sensor or one similar to it can be mounted anywhere within or on the conduit. An exemplary resistive sensor which is mounted within the conduit is described below in connection with FIG. 11.

Referring to FIG. 6, another embodiment of the invention is shown generally at **10*b*. Like numerals from the above-described embodiments have been utilized where appropriate, with differences being indicated by the suffix "b." A polishing fluid sensor 34 is provided and is mounted upstream of a rotary coupling 33 which is configured to impart rotation to carrier 20. Vacuum conduit 26*b* connects vacuum mechanism 50 and carrier 20. The polishing fluid sensor is coupled intermediate wafer carrier 20 and vacuum mechanism 50. In the illustrated example, polishing fluid sensor 34 comprises a pressure sensor which is configured to monitor the pressure within vacuum conduit 26*b* and sense pressure changes within the conduit. Pressure changes outside of a desired range can be indicative of a breach or rupture of resilient member 22. In one aspect, sensor 34 provides a leak detector which is mounted upstream of resilient member 22 and rotary coupling 33. Such sensor is preferably disposed within conduit 26***b*.

Referring to FIG. 7, an alternate embodiment of the present invention is shown generally at 10*c*. Like numerals from the above-described embodiment have been utilized where appropriate with differences being indicated by the suffix "c." In this example, polishing fluid sensor 34*c* is mounted downstream of rotary coupling 33, and intermediate resilient member and vacuum mechanism 50.

In accordance with another embodiment, a rupture sensor is provided and is configured to detect a rupture of the resilient member. In one aspect, the rupture sensor can comprise a fluid sensor or a pressure sensor such as those described above.

Figure 9:
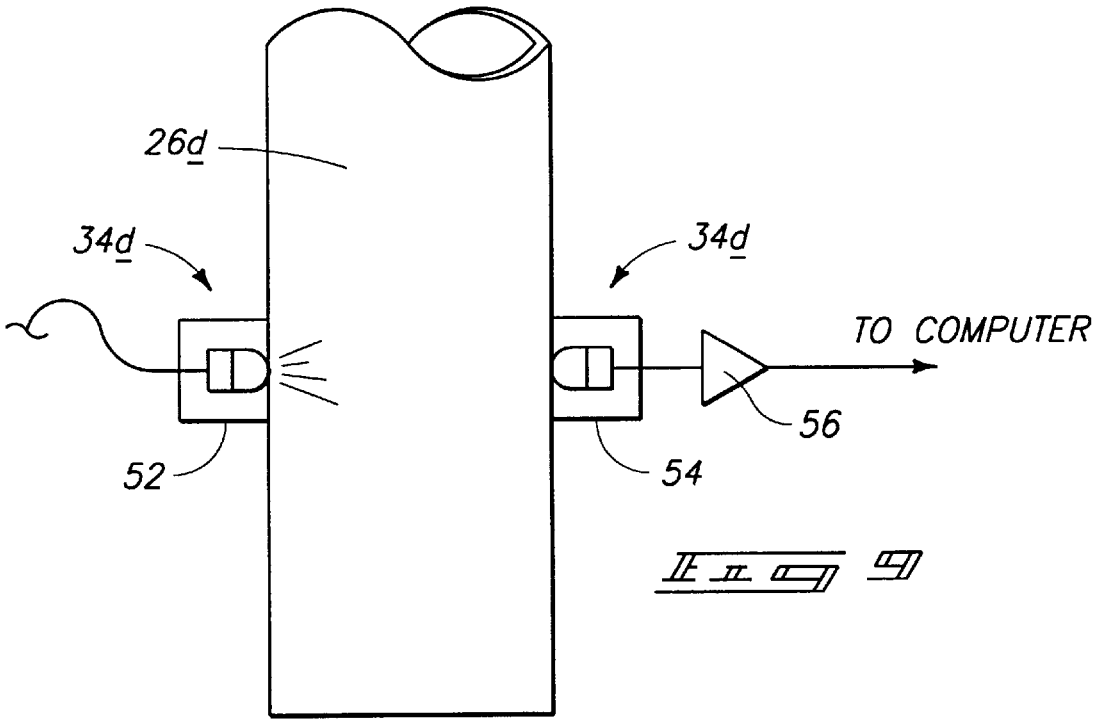
FIG. 9 is a side elevational view of a portion of a polishing system in accordance with one embodiment of the invention.

Referring to FIG. 9, like numerals from the above-described embodiments have been utilized where appropriate, with differences being indicated by the suffix "d" or with different numerals. Accordingly, a portion vacuum conduit 26*d* is shown. A sensor 34*d* is mounted on conduit 26*d*. In this example, conduit 26*d*, or at least a portion thereof is clear or translucent. Sensor 34*d* comprises an optoelectronic fluid sensor which is configured to sense the presence of fluid within the conduit. In a preferred embodiment, and in the context of a vacuum conduit which is made of or from material which is conducive to use with optoelectronic sensors, sensor 34*d* comprises a photo-emitter 52 and a detector 54. The emitter and detector are preferably positioned relative to one another sufficiently to detect the presence of fluid which passes relative to the two. In this specific example, the emitter and detector are positioned on opposite sides of the conduit so as to detect fluid which passes between the two. The emitter and detector can, however, be positioned anywhere on the conduit which permits detection of fluid, and not necessarily on opposite sides of the conduit. For example, the emitter and detector can be positioned, e.g. side-by-side, or one over the other, to allow for reflective detection by the detector of light emitted from the emitter. The emitter and detector can also comprise one integrated, self-contained unit. A detector circuit 56 can be provided to process the output of the emitter/detector pair or the emitter/detector unit. The output of detector circuit 56 can be passed to a control/monitoring system such as the one described below. The optoelectronic fluid sensor can also comprise a fiber optic light sensor which is operative in much the same way as described above.

Figure 10:
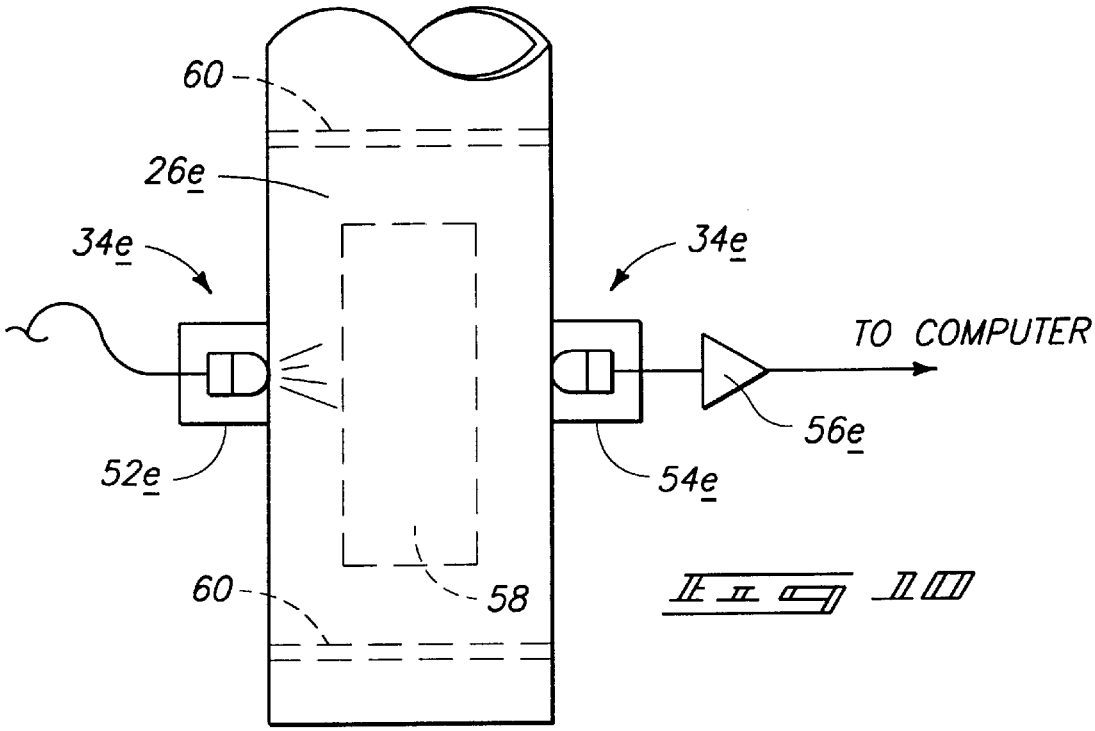
FIG. 10 is a side elevational view of a portion of a polishing system in accordance with one embodiment of the invention.

Referring to FIG. 10, like numerals from the above-described embodiments have been utilized where appropriate, with differences being indicated by the suffix "e" or with different numerals. Accordingly, a portion vacuum conduit 26*e* is shown. A sensor 34*e* is mounted on conduit 26*e*. In this example, conduit 26*e*, or at least a portion thereof is clear or translucent. Sensor 34*e* comprises an optoelectronic fluid sensor which is configured to sense the presence of fluid therein. Fluid sensing in this example takes place through the use of a color-reactive material which is disposed within the conduit. Various types of color reactive materials can be used including color-reactive desiccant beads or paper. Additionally, color-reactive membranes can be used and positioned with the conduit. In this example, an amount of desiccant paper 58 is disposed within the conduit where sensor 34*e* can monitor it for interaction with fluid. A pair of retainers or screens 60 are provided within the conduit and assist in maintaining the color-reactive material in place. In a preferred embodiment, and in the context of a vacuum conduit which is made of or from material which is conducive to use with optoelectronic sensors, sensor 34*e* comprises a photo-emitter 52*e* and a detector 54*e*. The emitter and detector are preferably positioned relative to one another sufficiently to detect the presence of fluid which passes relative to the two and affects the color-reactive material. In this specific example, the emitter and detector are positioned on opposite sides of the conduit so as to detect fluid which passes between the two. The emitter and detector can, however, be positioned anywhere on the conduit which permits detection of fluid in connection with the color-reactive material, and not necessarily on opposite sides of the conduit. For example, the emitter and detector can be positioned, e.g. side-by-side, or one over the other, to allow for reflective detection by the detector of light emitted from the emitter. The emitter and detector can also comprise one integrated, self-contained unit. A detector circuit 56*e* can be provided to process the output of the emitter/detector pair or the emitter/detector unit. The output of detector circuit 56*e* can be passed to a control/monitoring system such as the one described below. The optoelectronic fluid sensor can also comprise a fiber optic light sensor which is operative in much the same way as described above.

Figure 11:
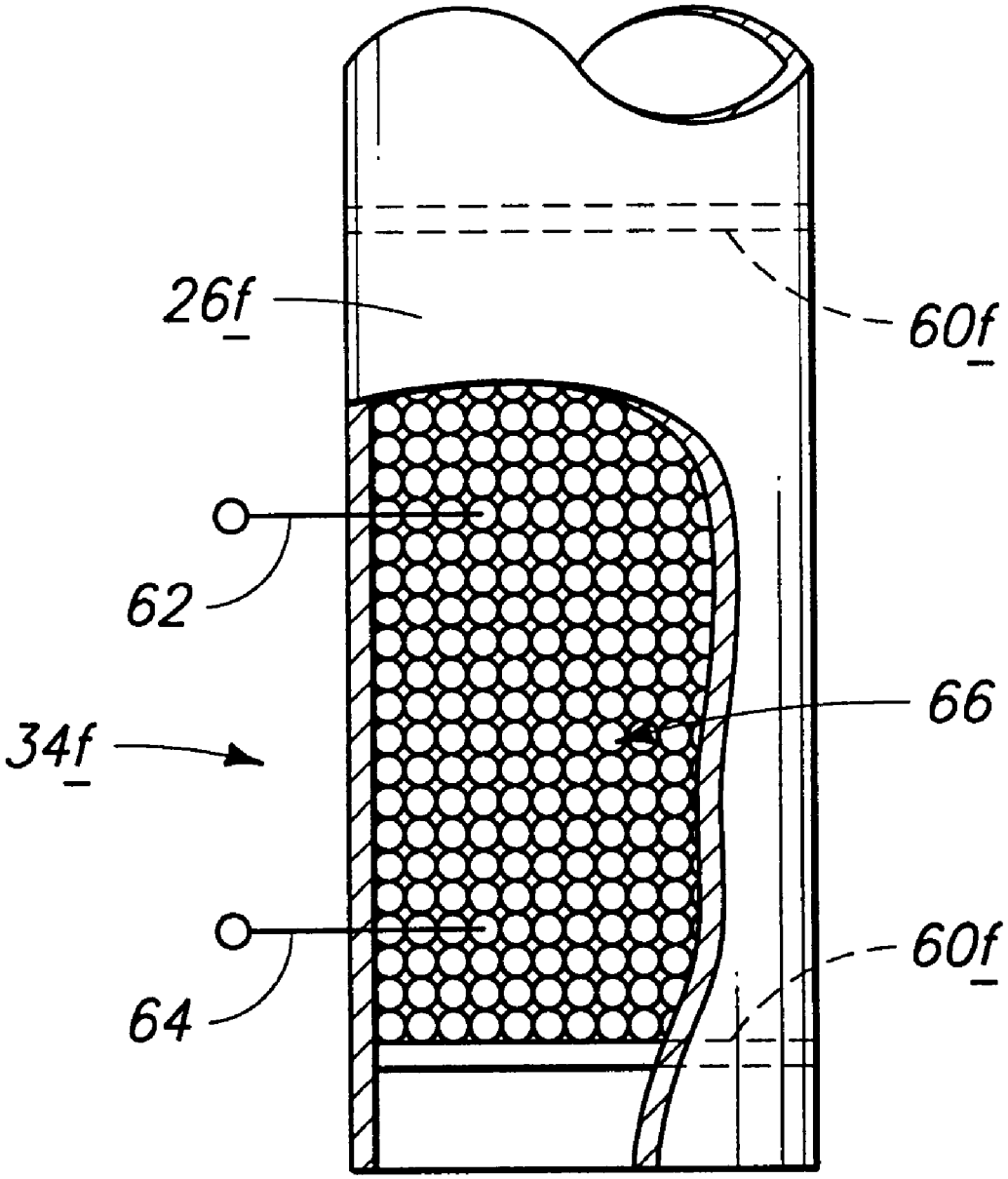
FIG. 11 is a side elevational view of a portion of a polishing system in accordance with one embodiment of the invention.

Referring to FIG. 11, like numerals from the above-described embodiments have been utilized where appropriate, with differences being indicated by the suffix "f" or with different numerals. Accordingly, a portion of a vacuum conduit 26*f* is shown. A sensor 34*f* is mounted on conduit 26*f*. Sensor 26*f* includes a pair of electrodes 62, 64 which extend into conduit 26*f*. In a preferred embodiment, a material 66 is provided within the conduit and engages electrodes 62, 64. Exemplary materials include reactive salts and/or other dielectric materials. Such material can be retained within the conduit by retainers or screens 60*f*. Such material can also be disposed on a membrane which is provided into the conduit for monitoring as described below. The resistance between electrodes 62, 64 through material 66 can be monitored. The resistance will typically equal a first value which is known. Material 66 will typically react with fluid to define a second resistance value which will alert the system that fluid has entered into the conduit. For example, reactive salts generally have a high resistance. However, when fluid interacts with such salts, the resistance is lowered, in some cases drastically. This reaction can be monitored for detecting a rupture or leak. In effect, sensor 34*f* comprises but one example of a resistor which is disposed within the vacuum conduit.

Various methods of the invention enable a microelectronic substrate, such as a semiconductor wafer, to be engaged with a vacuum conduit and a resilient expanse of material, such as conduit 26 and resilient member 22 (FIG. 1) sufficiently to develop a suction connection between the resilient expanse and the substrate. The substrate can be rotatably polished in the presence of a polishing fluid, and the integrity of the resilient expanse of material can be monitored sufficiently to detect a rupture thereof. Preferably such monitoring takes place independently of the suction developed by the vacuum conduit. Such monitoring can take place before, during or after the polishing of the substrate.

The various inventive embodiments described above can be used to prevent equipment damage by fluid contamination in pneumatic control systems. Leak detection can be utilized to detect chamber leaks that could present inaccurate pressure readings or cause moisture problems. The inventive embodiments can be utilized in connection with wafer carriers which use a resilient member to hold a wafer in place before, during, and/or after polishing. The inventive embodiments have particular utility in connection with a so-called Titan carrier available through Applied Materials, a Carrier X described in one or more of U.S. Pat. Nos. 5,449,316 and 5,423,716 to Strasbaugh, and the Orbital platen available through IPEC/Precision, formerly Westech Inc. of Phoenix, Ariz. The various described embodiments can also be useful for detecting a wafer break or slip during polishing.

Figure 8:
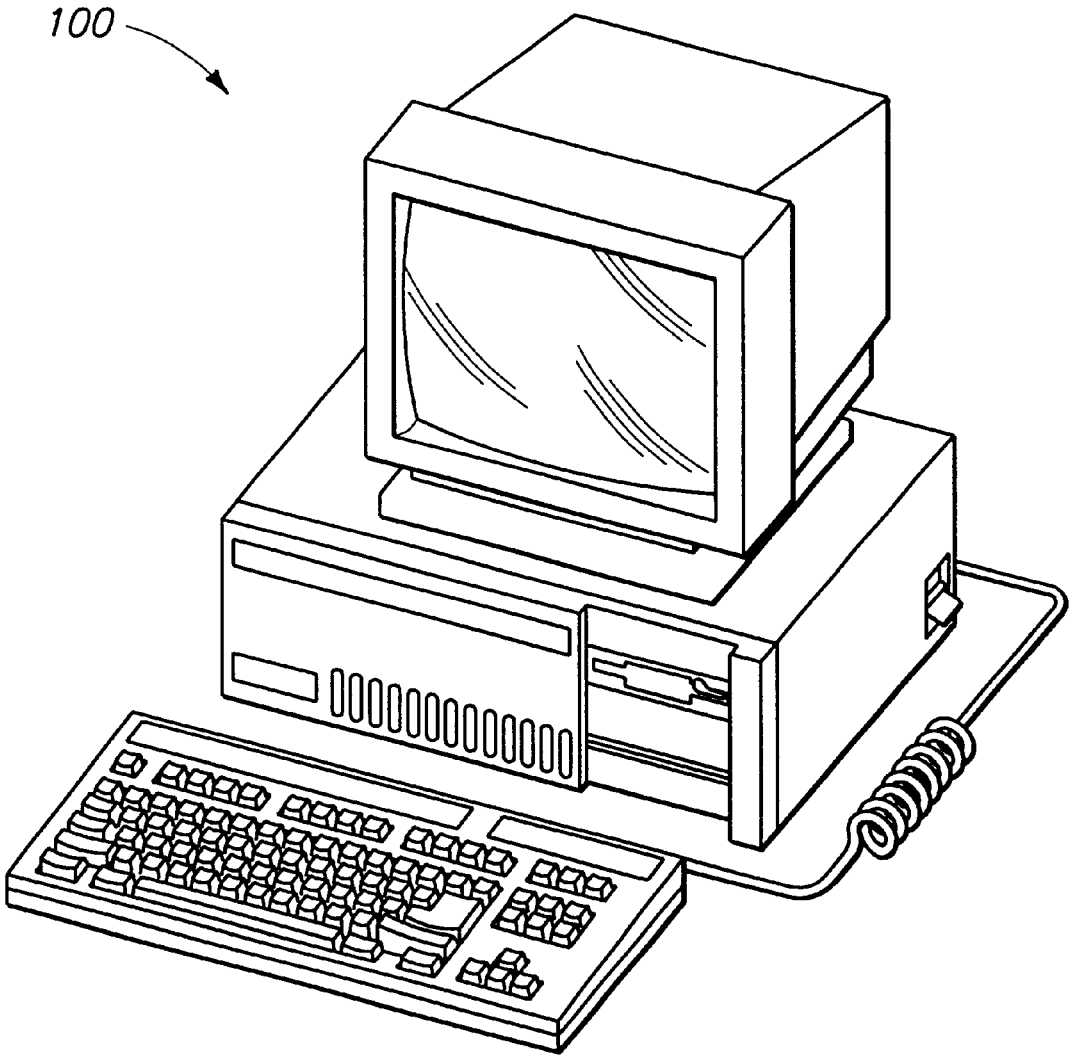
FIG. 8 is a view of a computer system which can be utilized in implementing one or more embodiments of the present invention.

Leak detection can be implemented in connection with a control/monitoring system, such as the computerized control/monitoring system shown at 100 in FIG. 8. The control/monitoring system can be an integrated system, or can have components which are discrete from one another. A computer system or a separate discrete system can be operably connected to any of the above-described embodiments and can monitor for leaks, and responsive to the detection of a leak, take appropriate remedial action. Such appropriate action can include issuing a warning, applying positive or negative pressure to the chamber, isolating the chamber with a valve, and/or shutting the polishing system down to name just a few. Monitoring can take place during polishing, between polishing cycles, after a given number of polishing cycles, or whenever impact on substrate throughput is minimized. Cost savings can be achieved by increasing the useful lifetimes of polishing systems, and by reducing the necessary maintenance and servicing requirements.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A microelectronic substrate polishing method comprising:

engaging a microelectronic substrate with a vacuum conduit and a resilient expanse of material configured to develop a suction connection between the resilient expense and the substrate;

rotatably polishing the substrate in the presence of a polishing fluid; and monitoring fluid barrier integrity of the resilient expanse of material independently of the suction developed by the vacuum conduit by detecting for presence of polishing fluid within the vacuum conduit sufficiently to detect a rupture of the resilient member.

2. The method of claim 1 wherein said monitoring comprises monitoring the integrity of the resilient expanse of material during said polishing.

3. A microelectronic substrate polishing method comprising:

engaging a microelectronic substrate with a vacuum conduit and a resilient expanse of material configured to develop a suction connection between the resilient expanse and the substrate;

rotatably polishing the substrate in the presence of a polishing fluid and monitoring fluid barrier integrity of the resilient expanse of material independently of the suction developed by the vacuum conduit by detecting for presence of polishing fluid within the vacuum conduit sufficiently to detect a rupture of the resilient member, wherein said monitoring comprises providing a fluid sensor in operative connection with said vacuum conduit and configured to detect the presence of the polishing fluid therein.

4. The method of claim 1 wherein said monitoring comprises providing an optoelectronic sensor.

5. A polishing method comprising:

providing a substrate carrier comprising a resilient member disposed over a portion of said substrate carrier configured to receive a microelectronic substrate, and a vacuum conduit, said vacuum conduit operably coupled to a vacuum mechanism;

positioning said microelectronic substrate proximate said resilient member;

reducing a pressure between said resilient member and said substrate carrier, the reducing being caused by activating said vacuum mechanism and being of sufficient magnitude to draw a portion of said resilient member toward the substrate carrier to cause an engagement between said resilient member and said microelectronic substrate received by the substrate carrier;

polishing the microelectronic substrate in the presence of a polishing fluid; and during polishing, monitoring said vacuum conduit intermediate said resilient member and said vacuum mechanism for presence of the polishing fluid therein.

6. The method of claim 5 wherein the monitoring comprises monitoring the pressure employing a pressure sensor.

7. A polishing method comprising:

providing a substrate carrier comprising a resilient member disposed over a portion of said substrate carrier configured to receive a microelectronic substrate, and a vacuum conduit, said vacuum conduit operably coupled to a vacuum mechanism;

positioning said microelectronic substrate proximate said resilient member;

reducing a pressure between said resilient member and said substrate carrier, the reducing being caused by activating said vacuum mechanism and being of sufficient magnitude to draw a portion of said resilient member toward the substrate carrier to cause an engagement between said resilient member and said microelectronic substrate received by the substrate carrier;

polishing the microelectronic substrate in the presence of a polishing fluid; and during polishing, monitoring said vacuum conduit intermediate said resilient member and said vacuum mechanism for presence of the polishing fluid therein, wherein the monitoring comprises providing a fluid sensor in operative connection with said vacuum conduit and configured to detect the presence of the polishing fluid therein.

8. The method of claim 7 wherein providing a fluid sensor comprises providing an optoelectronic sensor.

9. The method of claim 5 wherein the polishing comprises rotatably polishing.

10. The method of claim 1 wherein the monitoring comprises detecting for a change in resistance between two conductive electrodes.

11. The method of claim 5 wherein the monitoring comprises detecting for a change in resistance between two conductive electrodes.

12. A microelectronic substrate polishing method comprising:

engaging a microelectronic substrate with a vacuum conduit and a resilient expanse of material configured to develop a suction connection between the resilient expanse and the substrate;

rotatably polishing the substrate in the presence of a polishing fluid; and detecting for presence of the polishing fluid within the vacuum conduit.

13. The method of claim 12 wherein the detecting occurs during the polishing.

14. The method of claim 12 wherein the detecting is with an optoelectronic sensor.

15. The method of claim 12 wherein monitoring comprises for a change in resistance between two conductive electrodes.

* * * * *

UNITED STATES PATENT AND TRADEMARK OFFICE

CERTIFICATE OF CORRECTION

PATENT NO. : 6,416,402 B1
DATED : July 9, 2002
INVENTOR(S) : Scott E. Moore

It is certified that error appears in the above-identified patent and that said Letters Patent is hereby corrected as shown below:

Column 4,
Line 14, replace "FIG. 4 shows but one example of a resistive or" with -- FIG. 4 shows but one example of a resistive sensor --

Signed and Sealed this

Eighteenth Day of February, 2003

JAMES E. ROGAN
*Director of the United States Patent and Trademark Office*